United States Patent [19]

Bolton

[11] Patent Number: 4,682,731

[45] Date of Patent: Jul. 28, 1987

[54] EASY CLEAR SPRAY NOZZLE

[76] Inventor: John D. Bolton, 5 Shiloh Cir., Irvine, Calif. 92714

[21] Appl. No.: 702,572

[22] Filed: Feb. 1, 1985

Related U.S. Application Data

[63] Continuation-in-part of Ser. No. 514,694, Jul. 18, 1983, abandoned.

[51] Int. Cl.[4] ..... B05B 15/02

[52] U.S. Cl. ..... 239/119; 222/148

[58] Field of Search ..... 239/106, 110, 113, 119, 239/394; 222/148

[56] References Cited

U.S. PATENT DOCUMENTS

| | | | |
|---|---|---|---|
| 3,284,007 | 11/1966 | Clapp | 239/119 |
| 3,955,763 | 5/1976 | Pyle et al. | 239/119 |
| 4,513,913 | 4/1985 | Smith | 239/119 |

*Primary Examiner*—Joseph F. Peters, Jr.
*Assistant Examiner*—Scott Malpede

[57] ABSTRACT

The apparatus consists of two chambers, one inside the other, the outer being substantially larger than the inner, with a space between the chambers, but with inner projecting bumps or lands that seal to the outside surface of the inner chamber. Both chambers have holes to admit and conduct fluid and one of the holes is a spray nozzle. The various plates, chambers bumps and holes are arranged so that when the outer chamber is in one position spray fluid is conducted to the back of the spray nozzle which sprays in the ordinary way. When there is a blockage the user rotates the outer chamber to the alternate position which covers the spray nozzle, makes it confluent with the inner chamber, aligns a new set of openings, bumps block others, so that in this alternate position spray fluid pressure forces the spray fluid into the space between the chambers, into the spray nozzle opening and out a debris flushing outlet. This reverse flow carries blocking debris from the spray nozzle and discards them. Now the user rotates the outer chamber to the original position which aligns holes, blocks others, so that normal spraying may be resumed. What is new is an apparatus that gives the user a quick and convenient way to remove debris from a spray nozzle without taking anything apart or removing anything.

1 Claim, 4 Drawing Figures

FIG. 3
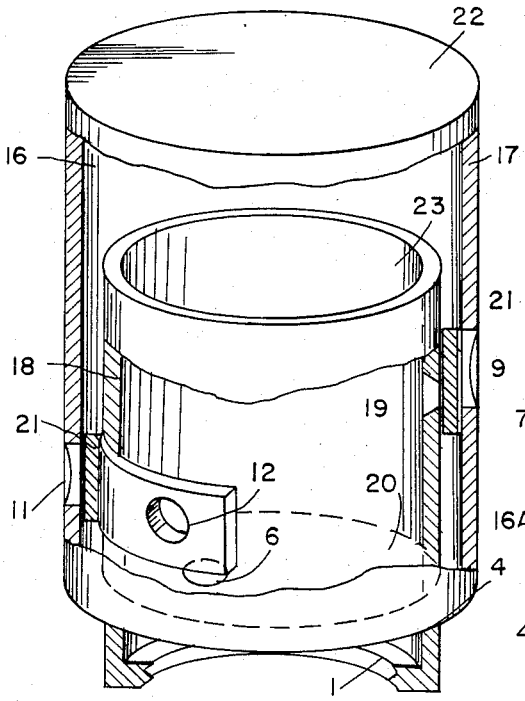
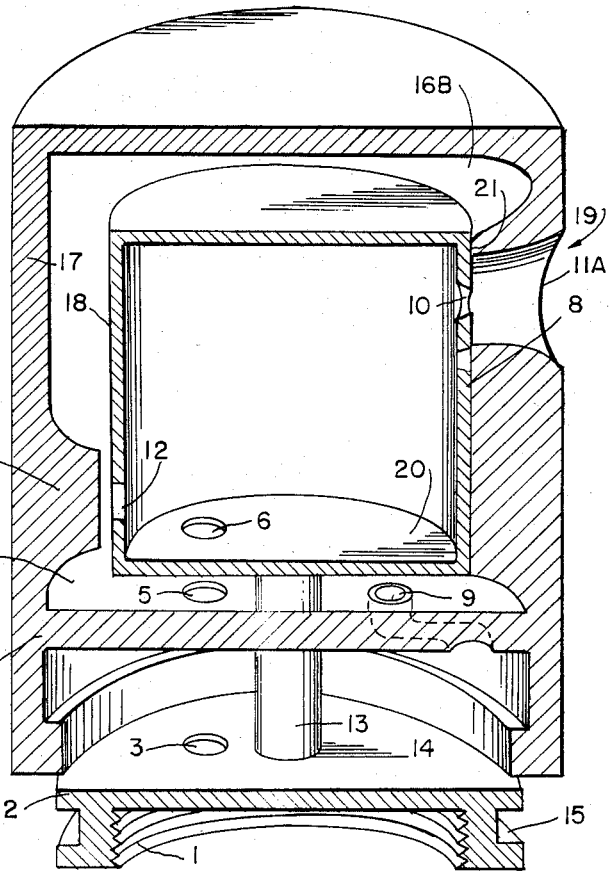
FIG. 1
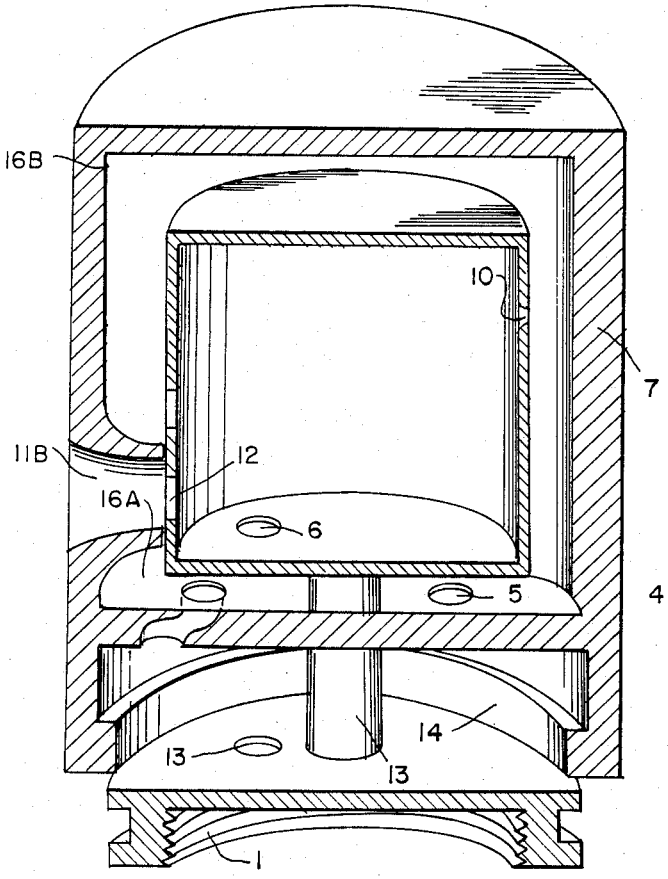
FIG. 2

EASY CLEAR SPRAY NOZZLE

This application is a continuation-in-part of application Ser. No. 514,694, filed July 18, 1983, now abandoned.

FIELD OF THE INVENTION

This apparatus relates to spray nozzles and more particularly to a means to remove debris from a spray nozzle.

DESCRIPTION OF THE PRIOR ART

At the present state of the art there are numerous configurations of spray nozzles in industry and homes. Paint is sprayed on cars and houses, water is sprayed on grass, insecticide on plants and animals, medicines on humans, fuel in engines and furnaces, and fire extinguishers utilize them. A spray orifice is a very useful object.

Because they have to have a fine opening in order to spray, dirt is a constant problem. Small particles block the orifice and destroy its usefulness. The pressure of the spray fluid behind the orifice drives the dirt deeper into the tiny opening. The usefulness of filters are limited because they reduce pressure and because particles can pass through filters on their long axis and lodge in the nozzle sideways.

At the present state of the art there is no solution to a blocked nozzle except to remove the nozzle and use a pick or pin to poke the dirt back into the central chamber and blow on it to get it out. It is a time consuming dirty business. Damage to the finely honed nozzle edge is a common result. Unblocking wastes time and costs money. Taking things apart can be very destructive to the spray fluid as where it is sterile or oxidizes quickly in air.

SUMMARY OF THE INVENTION

The apparatus consists of two chambers, one inside the other, the outer being substantially larger than the inner, thus creating a space between the two chambers, but the outer chamber having inner projecting bumps or lands that seal to the outside surface of the inner chamber and block openings if they are placed over the openings. Both chambers have holes to admit and conduct fluid and one of the holes is a spray nozzle.

The various plates, chambers and holes are arranged so that when the outer chamber is in one position spray fluid is conducted to the back of the spray nozzle which sprays in the ordinary way. When there is a blockage the user rotates the outer chamber to the alternate position which covers the spray nozzle, aligns a new set of openings, blocks others, so that in this alternate position spray fluid pressure forces the spray fluid into the space between the chambers, into the spray nozzle opening and out a debris flushing outlet. The reverse action carries blocking debris from the spray nozzle and discards them. Now the user rotates the outer chamber to the original position which aligns holes, blocks others, so that normal spraying may be resumed.

The object of my invention is to offer a mechanism that will enable the user to remove debris from a spray nozzle quickly and conveniently.

BRIEF DESCRIPTION OF THE DRAWINGS

In the drawing FIG. 1 is a perspective diagrammatic partially cut away view of the nozzle assembly in spray position. FIG. 2 is the same assembly rotated to debris flushing position.

FIG. 3 is a phantom drawing of the assembled apparatus.

DESCRIPTION OF THE PREFERRED EMBODIMENT

Figure 4:
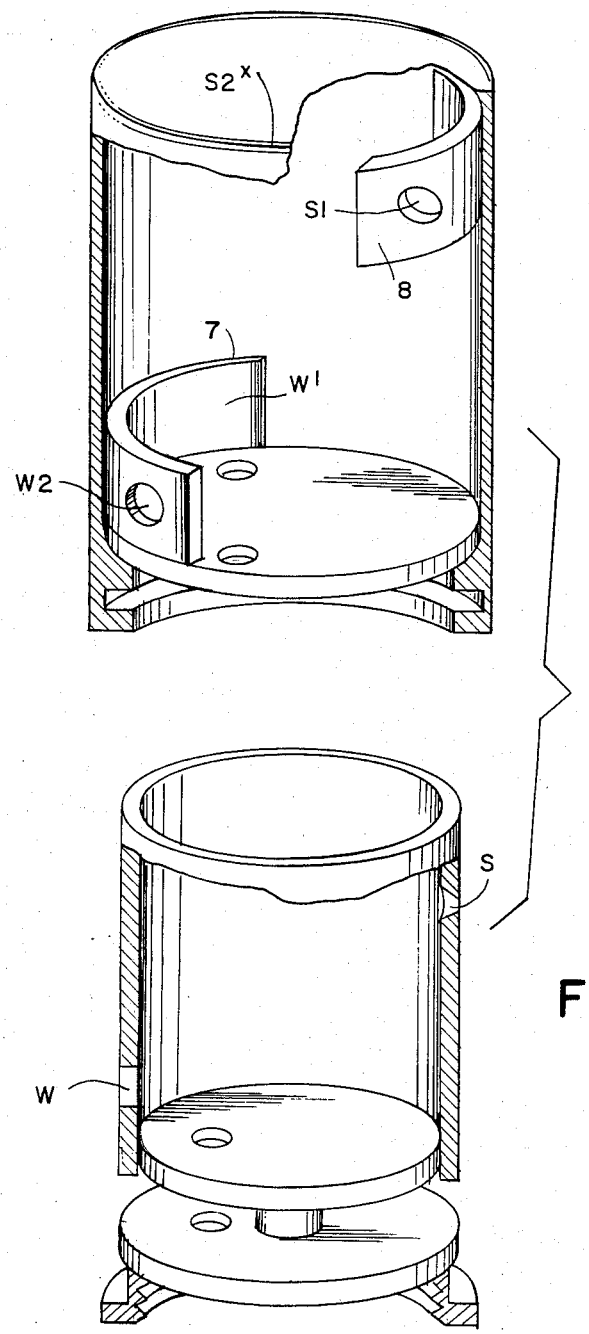
FIG. 4 is a phantom drawing of the apparatus shown dissassembled in a vertical direction.

In describing one selected embodiment of my invention illustrated in the drawing, specific terminology is resorted to for the sake of clarity; however, it is not intended to be limited to the specific terms so selected and it is to be understood that each specific term includes all technical equivalents which operate in a similar manner to accomplish a similar purpose.

Turning now to the specific embodiment of my invention selected for illustration, in the drawings,

1 is the feed pipe attachment,
2 is the fixed plate,
3 is the fixed plate feed hole,
4 is the lower plate of the outer movable chamber,
5 is outer chamber spray fluid conducting opening,
6 is inner spray chamber feed hole,
7 is outer chamber inward projecting debris flushing land,
8 is outer chamber inward projecting spray nozzle land,
9 is outer chamber spray fluid conducting opening,
10 is spray nozzle opening,
11*a* is outer chamber spray port,
11*b* is outer chamber debris port,
12 is debris flushing outlet,
13 is central fixed axle,
14 is male latch,
15 is female latch,
16 is space between chambers in region above debris flushing hole,
16*a* is space between chambers in region below inner chamber,
16*b* is space between chambers in region above spray outlet,
17 is outer chamber,
18 is inner chamber,
19 is spray nozzle,
20 is inner chamber base plate,
21 is outer chamber land,
22 is top of outer chamber,
23 is top of inner chamber,
24 is area of incoming spray material,
25 is inner chamber cavity.

OPERATION OF THE APPARATUS

The basic concept is to make two chambers, one fitting over the other, with a space between them, each with a series of holes, one hole for admission of spray material, one for spraying, one for flushing debris. The outer chamber has inner projecting lands or bumps that exactly fit over the inner chamber at selected points. When the outer chamber is in selected positions with respect to the inner chamber the lands seal off and prevent passage of fluid first from the debris flushing hole 12 when the device is in spraying configuration and then permitting fluid to flow from the outer chamber to the inner chamber through spray nozzle opening 10 when the device is in the flushing debris configuration.

The outer chamber has two holes in the base plate. In one position, say spray position, one of the holes, designated as the third hole in the claim and numbered 5 in the drawings, aligns with the hole in the base plate 3 and the hole in the inner chamber base plate 6, so that fluid can pass from the supply, across the base plate, across the base of the outer chamber, designated as the fourth hole in the claim and number 9 in the figures does not align with anything in this position and no fluid passes through it.

In another position, say debris flushing position, the second hole in the outer chamber, designated as the fourth hole in the claim and number 9 in the drawings, aligns with hole 3 in the base plate but does not align with hole 6 in the inner chamber so fluid is conducted into the space between the chambers. In this position the hole designated as the third hole in the claim does not align with anything and no fluid moves through it.

The holes are arranged so that when the outer chamber is in the first position, let us say the spray position, the holes and seals align so that fluid flows through the inner chamber 25 and emerges from the spray nozzle 10 in all drawings. In this position the lands are placed so that they seal off the debris flushing outlet 12 in all drawings. That situation may be seen in FIG. 1.

If the spray nozzle should block with debris the user rotates the outer chamber to a second position, characterized as "debris flushing position". In this position fluid is prevented from flowing into the inner chamber and out the spray opening by the lands, but instead flows between the chambers, around the inner chamber in the spaces 16*a* & 16*b*, into spray nozzle 10, across the inner chamber cavity 25 and out the debris flushing hole 12, in so doing, unblocking the spray nozzle 10 and carrying the debris out the debris flushing hole with it.

Looking now at the particularities of the drawings, in manufacture the unit is made so that in the spray position, shown in FIG. 1, the openings 3, 5 and 6 line up and the spray nozzle 10 is uncovered and the debris flushing outlet 12 is sealed. Now the fluid can flow through the inner chamber 18, the spray nozzle 10 and through the outer chamber spray port 11A. It remains in that position until debris clogs the spray nozzle.

To remove debris the user gives the outer chamber a partial turn. In the debris flushing position shown in FIG. 2, the manufacturer has made the parts so that the outer chamber fluid conducting opening 9 in all drawings, lines up with the fixed plate fluid conducting hole 3, thereby admitting fluid to the space between the inner and outer chambers 16*a* & 16*b*. In this position the holes 5 and 6 do not align with anything and do not conduct anything. In this position the debris flushing outlet 12 is uncovered by the land 7 and the spray nozzle 10 is covered to the outside but confluent with the space between the two chambers 16*a* & 16*b*. Now fluid flows around the outside of the inner chamber in the cavity between the inner and the outer chamber, flows backwards into the spray nozzle taking any debris with it and flushing it through the inner chamber 25, and to the outside through the debris flushing outlet 12 and outer chamber debris port 11B.

Now the user goes back to spraying by giving the outer chamber a partial rotation back to the spray position and holes and seals all align as explained above to permit spraying in the normal way. The time required to dislodge and flush debris and resume spraying should be only a second or so. Nothing needs to be disassembled to do it.

A further explanation, in accordance with FIG. 4 shows that the lower portion (inner chamber 18) is inserted upward into the portion shown at the top of the drawing (outer chamber 17). The inside surface of the lands (7 & 8) determines the operating position of the inner chamber. The thickness of the lands prevents the outside of the inner chamber from being in continuous contact with the inside of the outer chamber. The thickness of the lands causes a space or cavity to be created between the two chambers. This cavity is important to the function and operation of may apparatus.

The inner portion shows two openings in the side of the chamber marked "S" (for spray) and "W" for (waste) openings and referred to spray nozzle opening 10 and debris flushing outlet 12, respectively. For purposes of clarity of explanation this particular embodiment is showing the two openings on a diameter line of the chamber, that is at 3 and 9 o'clock if viewed from above. It is not necessary to the concept of my invention that these openings be opposite or that they be one above the other. In fact the device would function just as well if they were in any position including adjacent each other. Similarly, for purposes of clarity of explanation the S and W openings are shown one above the other, but these positions are not necessary for the operation of the apparatus. The apparatus works the same no matter what the relative positions of these two openings.

In use, say in spray position, the outer chamber is rotated around the inner chamber until the opening S is in the center of the opening in the land, called a port herein, labeled "S1" (outer chamber spray port 11A). In this position the opening W is over the land in the position marked "W1". In this position holes in the bases of the chambers and plates are in alignment so that spray fluid is forced through the bottom of the outer chamber, through the bottom of the inner chamber, passes across the inner chamber, and passes out through the two openings S and S1, now in alignment. No fluid passes out of the W opening because it is against the land at the point W2.

In the event of a blockage the user rotates the outer chamber about the inner chamber until the opening W is in the center of the land opening marked W2 (outer chamber debris port 11B). In this position the spray opening S is not against any portion of any land so it is open into the cavity between the chambers. In this position all the holes in the base plates do not align and spray fluid cannot not pass directly into the bottom of the small chamber as it did before. However, in this position, selected holes in the base plate and base of the outer chamber do align, so that spray fluid may now pass into the cavity between the chambers. The only exit from the cavity between the chambers is into a S opening, now uncovered, and fluid forced that is into the cavity between the chambers continues to travel into the spray nozzle opening S, taking spray nozzle blocking debris with it, entering, and eventually crossing the small chamber. The only exit from the small chamber is the openings W and W2, now in alignment, and fluid is forced through these openings to emerge to the outside, carrying the spray nozzle blocking debris with it.

To return to spraying the user rotates the outer chamber until once again the S and S1 openings are in alignment and the fluid path is as previously described.

It is to be understood that the form of my invention selected for illustration here and described herein is to be taken as a preferred embodiment. For example equivalent elements may be substituted for those illustrated and described. There may be any configuration of holes and chambers so long as the essential idea of forward and reversing pressures with a movement of one of the chambers is maintained. There may be additional plate gaskets, seals and "O" rings to maintain tight seals without departing from the scope and spirit of my invention.

The advantages of my invention are that the user may quickly and conveniently unblock a plugged spray orifice.

Having thus described and disclosed my invention I claim:

1. An apparatus for unblocking a spray nozzle plugged with debris consisting of, in combination:

a fixed plate with a central axle, a first hole in said plate confluent with a source of pressurized spraying material, an inner chamber, having an inner cavity, said inner chamber including a base plate, with a second hole therein intended to conduct pressurized spray material into the inner cavity of said inner chamber, said inner chamber base plated fixed on said central axle, and said inner chamber having a spray nozzle opening, and an opening intended to eliminate debris, characterized herein as a debris flushing outlet, an outer chamber, including a base plate aligned on said central axle, and rotatably fixed to said axle, said outer chamber base plate having third and fourth holes intended to conduct pressurized spray material across the outer chamber base plate of said outer chamber, said outer chamber being substantially larger than said inner chamber, and more or less enclosing said inner chamber, there being a confluent space between said inner chamber, a cavity connecting upper and lower spaces defined by the inner chamber disposed in said outer chamber, said outer chamber having a plurality of inwardly projecting lands, exactly fitting to and sealing said inner chamber, thereby sealing off the openings for spraying and debris flushing when said lands are placed over those openings, and said outer chamber having an outer chamber port that is sealed from the central cavity by one of said inwardly projecting lands, but which permit material to pass out of said outer chamber, and wherein said hole and land are so placed that when the outer chamber is rotated over and around the inner chamber on the central axle, to one position, characterized herein as spray position, spray material passes through said first hole in the fixed plate, through said third hole in the base plate of the outer chamber, through said second hole in the base plate of the inner chamber, into the inner chamber cavity, through said inner chamber cavity, and out of said inner chamber through the spray nozzle opening, and to the outside through said outer chamber port, and in this position said fourth hole is out of alignment and does not permit spray material to enter or to pass through the space between the chambers, and the outer chamber has a port aligned over said spray nozzle opening which permits said pressurized spray material to pass to the outside, and said debris flushing outlet is sealed off by an outer chamber inwardly projecting land which is placed over it by the rotation of said outer chamber into said spray and when said outer chamber is rotated on said axle, over and around the inner chamber, and left in a second position, characterized herein as debris flushing position, said first and fourth holes now align and said inwardly projecting land is moved off the said debris flushing outlet, and said debris flushing outlet is now aligned by said outer chamber port, thereby permitting material to escape to the outside, and said outer chamber encloses but does not block said inner chamber spray nozzle opening, and said pressurized spray material is forced through said first and fourth holes, into the space and cavity between the inner and outer chambers, and flows into the spray nozzle, taking debris with it and unblocking said spray nozzle opening, travels through and across the inner chamber cavity and out said debris flushing hole, and through said outer chamber port chamber to the outside, and in this said debris flushing position the holes designated as second and third holes are out of alignment and no pressurized spray material passes through them.

* * * * *